US009477177B2

(12) United States Patent
Leemhuis et al.

(10) Patent No.: US 9,477,177 B2
(45) Date of Patent: Oct. 25, 2016

(54) TONER CARTRIDGE HAVING A SHUTTER LOCK MECHANISM

(71) Applicant: Lexmark International, Inc., Lexington, KY (US)

(72) Inventors: Michael Craig Leemhuis, Nicholasville, KY (US); James Daniel Anderson, Jr., Harrodsburg, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/474,423

(22) Filed: Sep. 2, 2014

(65) Prior Publication Data

US 2016/0062271 A1 Mar. 3, 2016

(51) Int. Cl.
*G03G 15/08* (2006.01)

(52) U.S. Cl.
CPC .. *G03G 15/0886* (2013.01); *G03G 2215/0692* (2013.01); *G03G 2221/1684* (2013.01)

(58) Field of Classification Search
None
See application file for complete search history.

(56) References Cited

U.S. PATENT DOCUMENTS

| | | | | |
|---|---|---|---|---|
| 5,083,158 | A | 1/1992 | Kashima et al. | |
| 5,121,165 | A | 6/1992 | Yoshida et al. | |
| 5,608,501 | A | 3/1997 | Makino | |
| 5,614,996 | A * | 3/1997 | Tanda | G03G 21/12 141/363 |
| 5,758,233 | A | 5/1998 | Coffey et al. | |
| 5,842,093 | A | 11/1998 | Tanda | |
| 6,014,536 | A | 1/2000 | Ban et al. | |
| 6,128,453 | A | 10/2000 | Ban et al. | |
| 6,144,821 | A | 11/2000 | Oguma | |
| 6,259,874 | B1 | 7/2001 | Murakami et al. | |
| 6,266,505 | B1 | 7/2001 | Ban et al. | |
| 6,594,458 | B2 | 7/2003 | Ban et al. | |
| 6,792,228 | B2 | 9/2004 | Ban et al. | |
| 6,853,828 | B2 | 2/2005 | Ban et al. | |
| 6,968,139 | B2 | 11/2005 | Ban et al. | |
| 6,978,101 | B2 | 12/2005 | Ban et al. | |

(Continued)

FOREIGN PATENT DOCUMENTS

| | | |
|---|---|---|
| EP | 1434110 A1 | 6/2004 |
| EP | 2290461 A2 | 3/2011 |

OTHER PUBLICATIONS

Attached Information Disclosure Statement containing pictures of a toner cartridge compatible with the Sharp Electronics Corporation MX-C402SC laser printer and a toner cartridge compatible with the Sharp Electronics Corporation MX-C250 and MX-C300W laser printers.

(Continued)

*Primary Examiner* — David Gray
*Assistant Examiner* — Geoffrey T Evans
(74) *Attorney, Agent, or Firm* — Justin M. Tromp

(57) ABSTRACT

A toner cartridge according to one example embodiment includes a body having a reservoir for storing toner. The body has an outlet port in fluid communication with the reservoir for exiting toner from the reservoir. A shutter positioned at the outlet port is slidable between a closed position blocking the outlet port and an open position unblocking the outlet port. A lock is sandwiched between a portion of the shutter that faces the outlet port and a portion of the body that the shutter slides along. The lock is movable between a locked position blocking the shutter from moving from the closed position to the open position and an unlocked position permitting the shutter to move from the closed position to the open position.

20 Claims, 13 Drawing Sheets

(56) References Cited

U.S. PATENT DOCUMENTS

| | | | | |
|---|---|---|---|---|
| 7,386,250 | B2 | 6/2008 | Ban et al. | |
| 7,548,710 | B2 | 6/2009 | Gayne et al. | |
| 7,606,520 | B2 | 10/2009 | Dawson | |
| 8,165,505 | B2 | 4/2012 | Kojima | |
| 8,588,659 | B2 | 11/2013 | Carter et al. | |
| 8,682,213 | B2 | 3/2014 | Carter et al. | |
| 8,761,639 | B1 | 6/2014 | Leemhuis et al. | |
| 8,913,927 | B2 * | 12/2014 | Oda | G03G 15/0875 399/114 |
| 9,146,497 | B2 * | 9/2015 | Nodera | G03G 15/0886 |
| 2001/0001025 | A1 | 5/2001 | Nakajima | |
| 2003/0223775 | A1 | 12/2003 | Yoshino et al. | |
| 2005/0169672 | A1 | 8/2005 | Ban et al. | |
| 2005/0201777 | A1 | 9/2005 | Konishi | |
| 2006/0067725 | A1 | 3/2006 | Miyabe et al. | |
| 2006/0171744 | A1 | 8/2006 | Ikeda et al. | |
| 2007/0212118 | A1 | 9/2007 | Nagae et al. | |
| 2007/0286634 | A1 | 12/2007 | Blaine et al. | |
| 2008/0101821 | A1 | 5/2008 | Gayne et al. | |
| 2009/0142103 | A1 | 6/2009 | Chaudhuri et al. | |
| 2009/0297209 | A1 | 12/2009 | Nakajima et al. | |
| 2010/0166460 | A1 * | 7/2010 | Maeshima | G03G 15/0868 399/119 |
| 2010/0221039 | A1 | 9/2010 | Kawai et al. | |
| 2011/0052266 | A1 * | 3/2011 | Yoon | G03G 21/1814 399/258 |
| 2012/0219330 | A1 | 8/2012 | Kikuchi et al. | |
| 2013/0121731 | A1 * | 5/2013 | Takashima | G03G 15/0886 399/258 |
| 2013/0121732 | A1 * | 5/2013 | Takashima | G03G 15/0886 399/258 |
| 2013/0170864 | A1 | 7/2013 | Newman et al. | |
| 2014/0241758 | A1 | 8/2014 | Rulon et al. | |

OTHER PUBLICATIONS

Extended European Search Report dated Mar. 10, 2016 for European Patent Application No. 15183146.8.

* cited by examiner

TONER CARTRIDGE HAVING A SHUTTER LOCK MECHANISM

CROSS REFERENCES TO RELATED APPLICATIONS

None.

BACKGROUND

1. Field of the Disclosure

The present disclosure relates generally to image forming devices and more particularly to a toner cartridge having a shutter lock mechanism.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

Toner is fed from a reservoir in the toner cartridge through an outlet port on the toner cartridge and into an inlet port on the imaging unit. The toner cartridge may include a shutter that seals the outlet port when the toner cartridge is not installed in the image forming device. The shutter may be biased toward a closed position in order to prevent the undesired release of toner. As the toner cartridge is inserted into the image forming device and the outlet port of the toner cartridge mates with the corresponding inlet port, an engagement feature in the image forming device opens the shutter so that toner may be delivered through the outlet port. Toner leakage may be experienced if the shutter opens when the outlet port is not mated with the corresponding inlet port, such as if the shutter opens prematurely during insertion of the toner cartridge into the image forming device or if a user unintentionally opens the shutter or intentionally opens the shutter without appreciating its purpose. The leaked toner may cause uncleanliness or, if the leaked toner falls into portions of the image forming device, print defects. Accordingly, it will be appreciated that a mechanism that prevents the unwanted release of toner from the outlet port of the toner cartridge is desired.

SUMMARY

A toner cartridge according to one example embodiment includes a body having a reservoir for storing toner. The body has an outlet port in fluid communication with the reservoir for exiting toner from the reservoir. A shutter positioned at the outlet port is slidable between a closed position blocking the outlet port and an open position unblocking the outlet port. A lock is sandwiched between a portion of the shutter that faces the outlet port and a portion of the body that the shutter slides along. The lock is movable between a locked position blocking the shutter from moving from the closed position to the open position and an unlocked position permitting the shutter to move from the closed position to the open position.

A toner cartridge according to another example embodiment includes a body having a reservoir for storing toner. The body has an outlet port in fluid communication with the reservoir for exiting toner from the reservoir. A shutter positioned at the outlet port is slidable between a closed position blocking the outlet port and an open position unblocking the outlet port. The toner cartridge includes a resiliently deflectable wire having a bend formed therein. A portion of the wire on one side of the bend forms a locking arm and a portion of the wire on the other side of the bend forms a bias arm. The locking arm includes a blocking surface and is movable between a locked position where the blocking surface blocks the shutter from moving from the closed position to the open position and an unlocked position where the blocking surface is clear from a sliding path of the shutter permitting the shutter to move from the closed position to the open position. The locking arm is biased by the bias arm toward the locked position.

A toner cartridge according to another example embodiment includes a body having a reservoir for storing toner. The body has an outlet port in fluid communication with the reservoir for exiting toner from the reservoir. A shutter positioned at the outlet port is slidable between a closed position blocking the outlet port and an open position unblocking the outlet port. A pair of opposed rails extend along a sliding path of the shutter. The shutter slides along the rails when the shutter slides between the open position and the closed position. A lock mounted on the rails is resiliently deflectable between a locked position blocking the shutter from moving from the closed position to the open position and an unlocked position permitting the shutter to move from the closed position to the open position.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
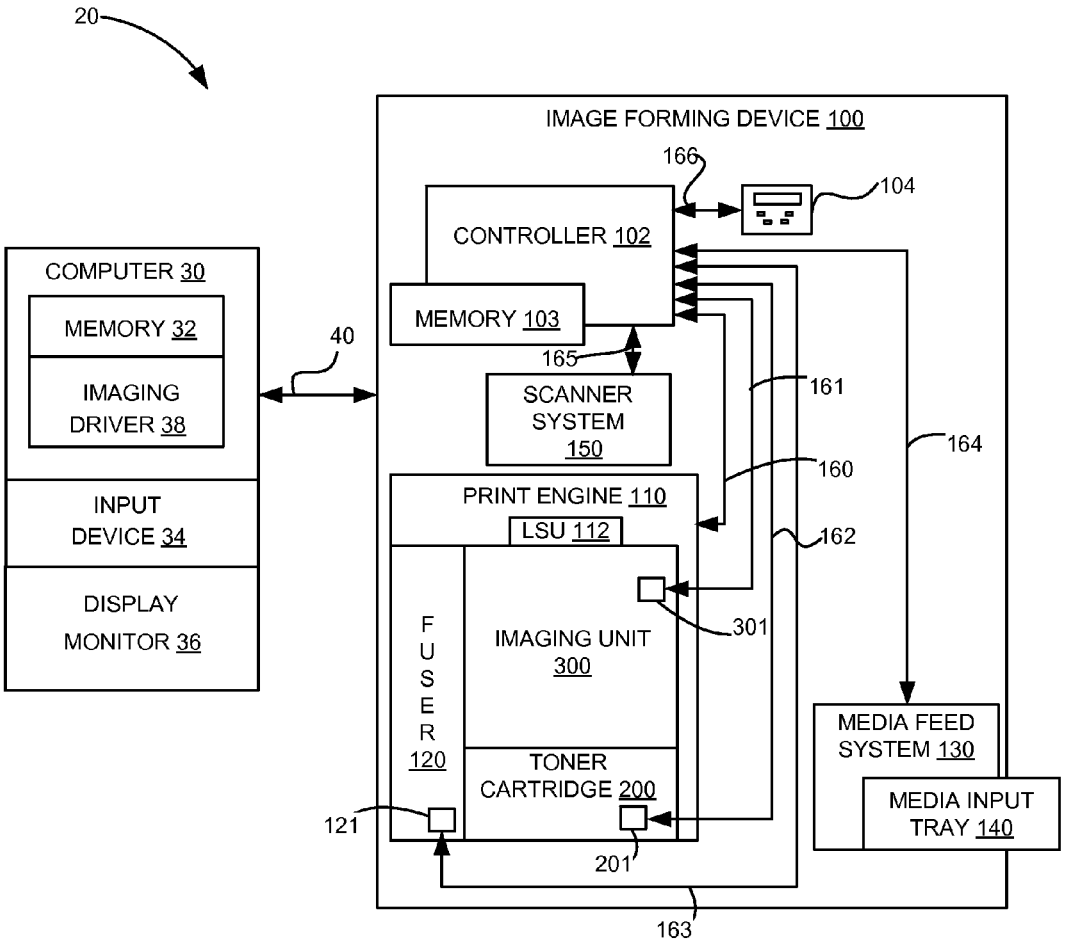
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
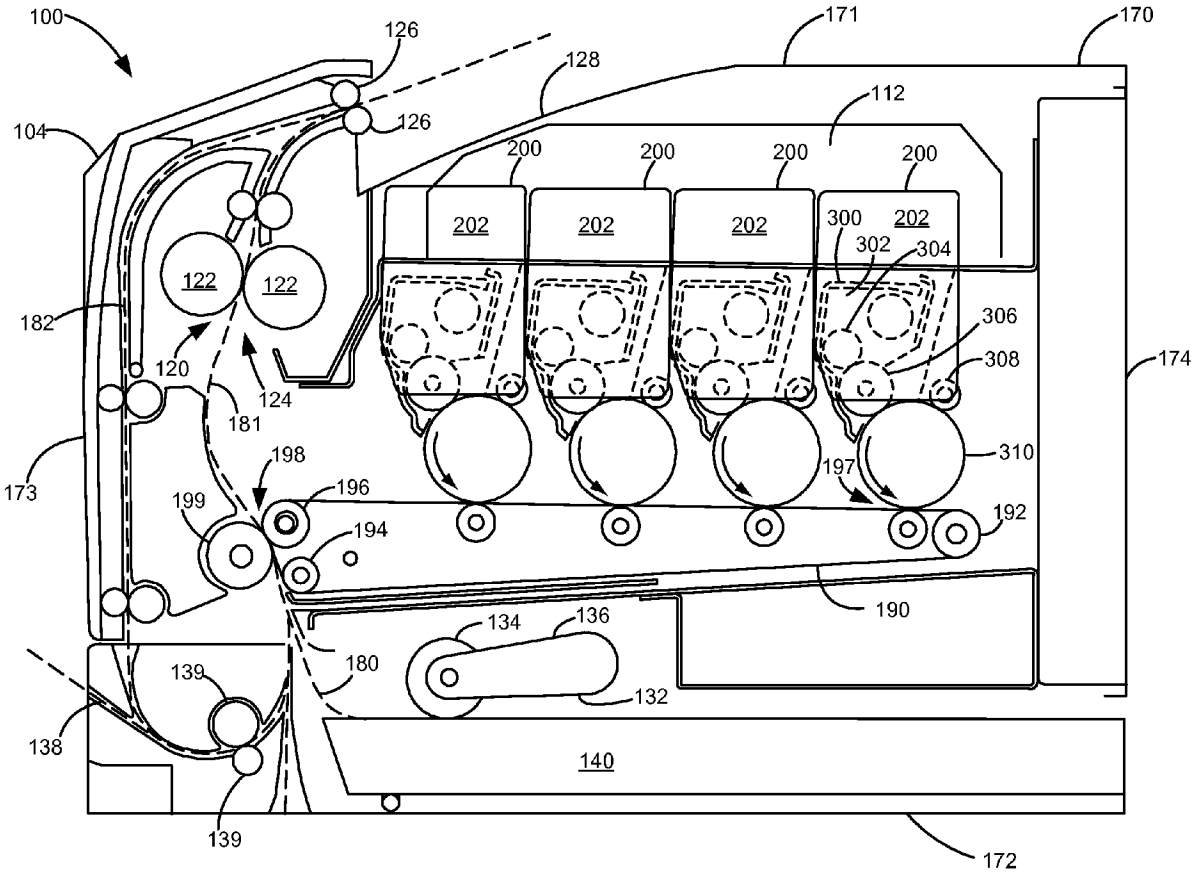
FIG. 2 is a schematic diagram of an image forming device according to a first example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
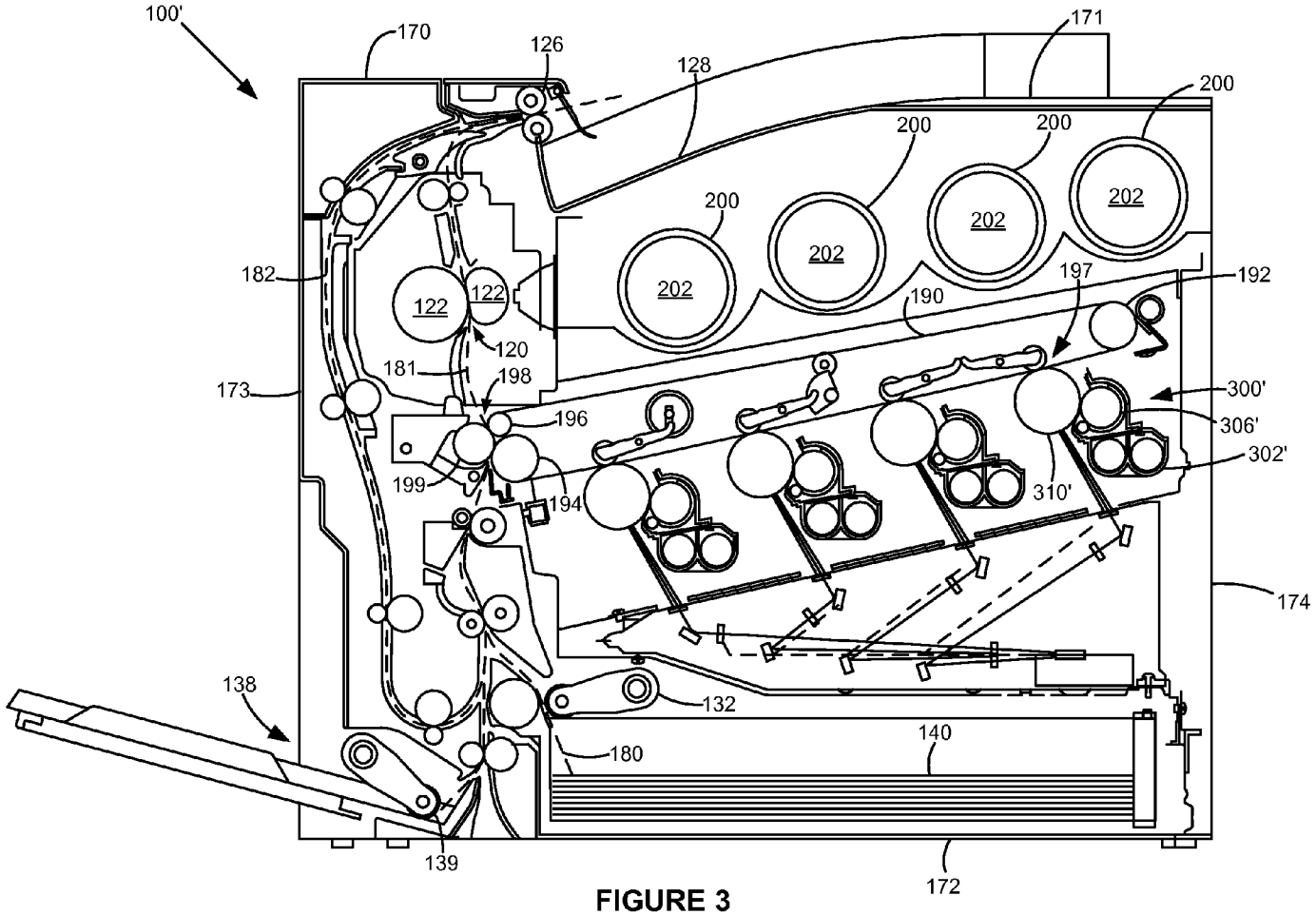
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although image forming devices 100 and 100' utilize ITM 190 to transfer toner to the media, toner may be applied directly to the media by the one or more photoconductive drums 310, 310' as is known in the art. In addition, toner may be transferred directly from each toner cartridge 200 to its corresponding imaging unit 300 or 300' or the toner may pass through an intermediate component such as a chute, duct or hopper that connects the toner cartridge 200 with its corresponding imaging unit 300 or 300'.

Figure 4:
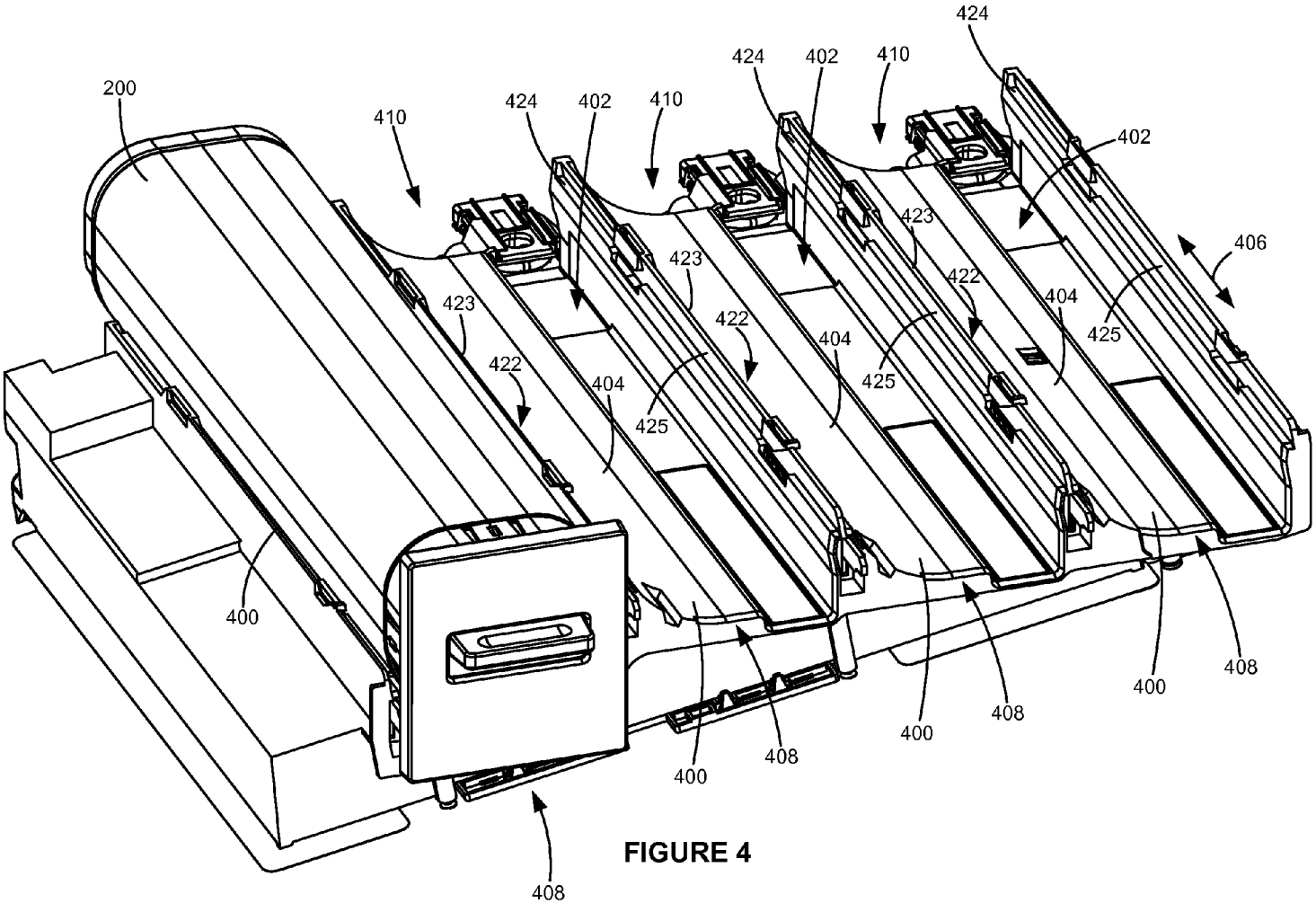
FIG. 4 is a perspective view of four trays positioned to hold four corresponding toner cartridges in the image forming device according to one example embodiment.

With reference to FIG. 4, four trays 400 are shown positioned in image forming device 100, 100' according to one example embodiment. Each tray 400 includes a cartridge storage area 402 that is sized and shaped to hold a corresponding toner cartridge 200. In one embodiment, each toner cartridge 200 is independently insertable into and removable from its corresponding tray 400 in order to permit a user to individually remove and replace each toner cartridge 200 when it runs out of usable toner. In the example embodiment illustrated, cartridge storage area 402 is defined by a top surface 404 that generally conforms to the shape of the exterior of the lower portion of toner cartridge 200 including the bottom and sides of toner cartridge 200. Cartridge storage area 402 extends along a lengthwise dimension 406 and is open at a front end 408 to permit the insertion and removal of the corresponding cartridge 200 into and out of cartridge storage area 402. Front end 408 is accessible to a user upon opening one or more access doors or panels on housing 170 of image forming device 100, 100'. Tray 400 includes alignment features that position toner cartridge 200 in cartridge storage area 402. For example, in the embodiment illustrated, each tray 400 includes a pair of loading rails 422, 424 running along lengthwise dimension 406 of cartridge storage area 402 between front end 408 and a rear end 410 of cartridge storage area 402. Loading rails 422, 424 are positioned on opposite sides of cartridge storage area 402 to engage opposite sides of the toner cartridge 200 installed therein. In the embodiment illustrated, a side restraint 423, 425 in the form of a substantially vertical wall is positioned above each loading rail 422, 424 to limit the side-to-side motion of toner cartridge 200 in cartridge storage area 402.

Figure 5:
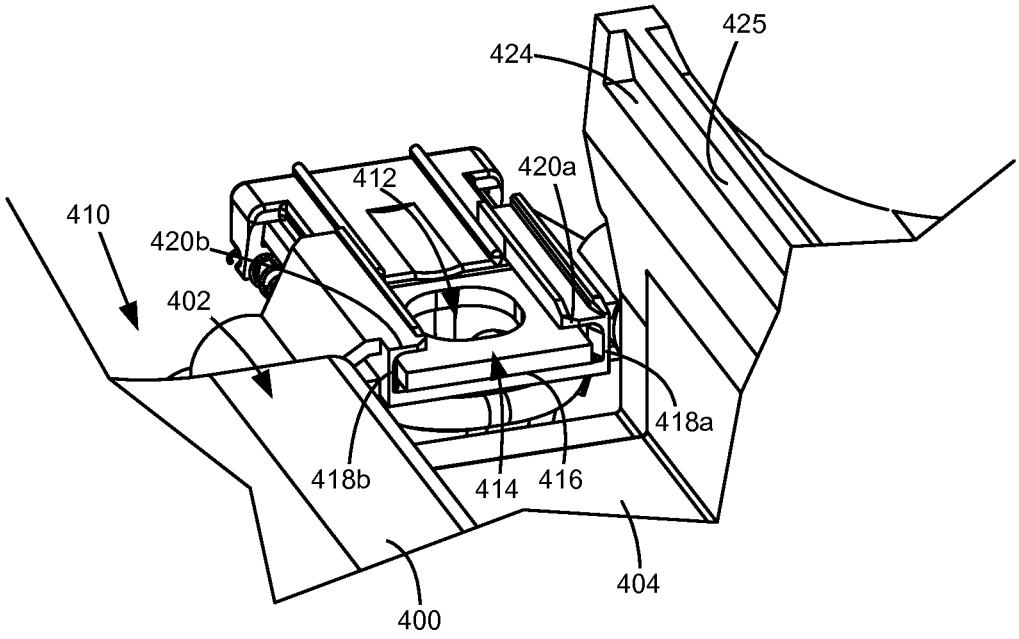
FIG. 5 is a perspective view of a toner inlet port positioned adjacent to one of the trays of FIG. 4 according to one example embodiment.

With reference to FIG. 5, a toner inlet port 412 is positioned in each cartridge storage area 402 to receive toner from a corresponding outlet port of toner cartridge 200. In the example embodiment illustrated, inlet port 412 is positioned near rear end 410 of cartridge storage area 402. Inlet port 412 may be a component of imaging unit 300, 300' or an intermediate component such as a chute, duct or hopper that permits toner flow from toner cartridge 200 to its corresponding imaging unit 300, 300'. In the example embodiment illustrated, inlet port 412 is surrounded by a forward facing generally C-shaped channel 414. Channel 414 aids in aligning the outlet port of toner cartridge 200 with inlet port 412. Channel 414 is formed by a bottom surface 416, opposed generally vertical walls 418*a*, 418*b* and ledges 420*a*, 420*b* that extend in a generally horizontal direction from walls 418*a*, 418*b*, respectively. Inlet port 412 is formed in bottom surface 416. Walls 418*a*, 418*b* extend upward from bottom surface 416 on opposite sides of inlet port 412. Ledges 420*a*, 420*b* extend inward toward each other from top portions of walls 418*a*. 418*b*. In particular, ledge 420*a* extends from a top portion of wall 418*a* toward wall 418*b* and ledge 420*b* extends from a top portion of wall 418*b* toward wall 418*a*. In one embodiment, bottom surface 416, walls 418*a*, 418*b* and/or ledges 420*a*, 420*b* have tapered surfaces leading into channel 414 to facilitate the entry of toner cartridge 200.

Figure 6:
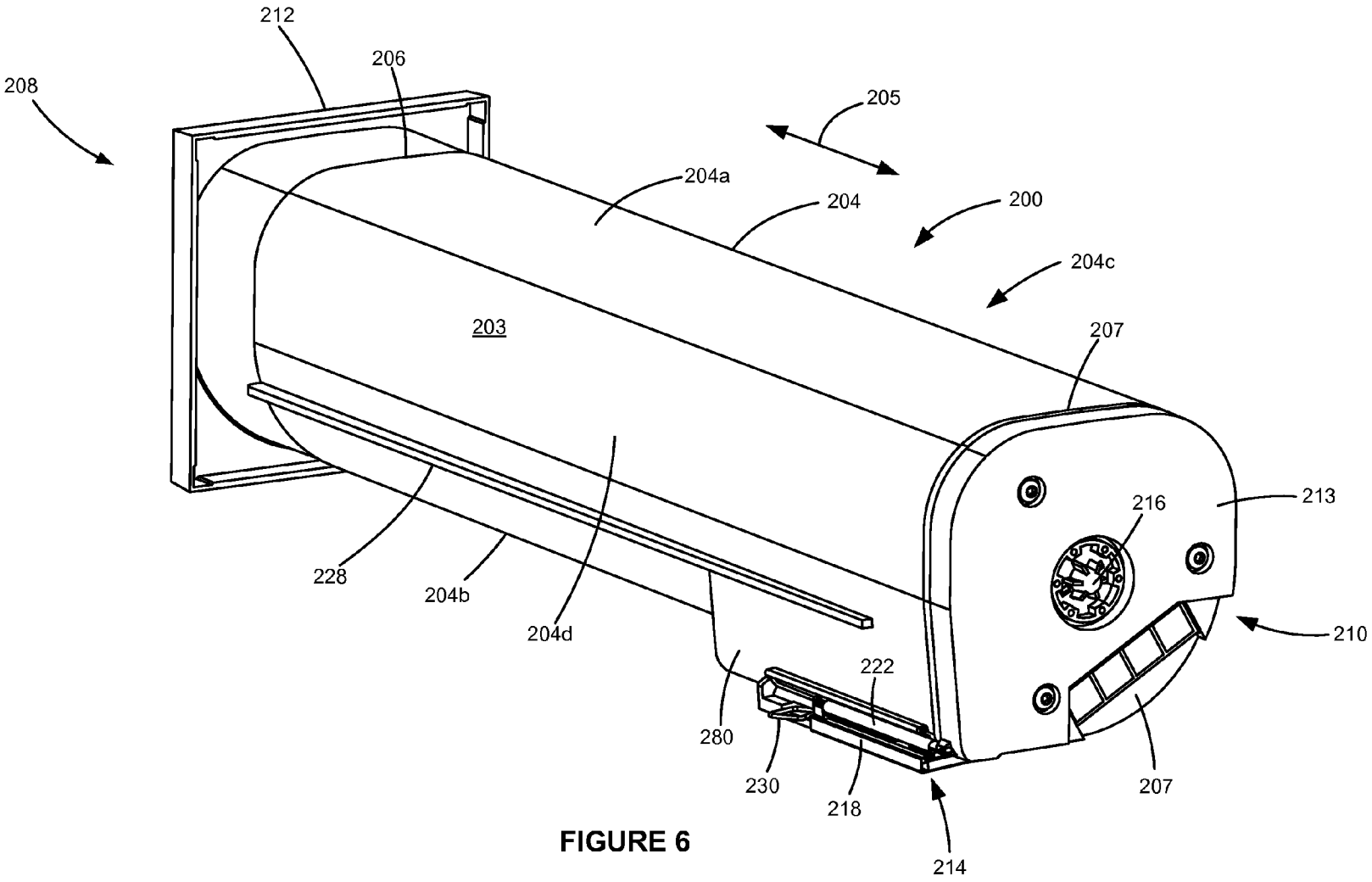
FIG. 6 is a rear perspective view of a toner cartridge according to one example embodiment.

FIGS. 6-9 show toner cartridge 200 according to one example embodiment. With reference to FIG. 6, toner cartridge 200 includes an elongated body 203 that includes walls forming toner reservoir 202 (FIGS. 2 and 3). In the example embodiment illustrated, body 203 includes a generally cylindrical wall 204 that extends along a lengthwise dimension 205 and a pair of end walls 206, 207 defining a front end 208 and a rear end 210, respectively, of toner cartridge 200. Wall 204 includes a top 204*a*, bottom 204*b* and sides 204*c*, 204*d*. In the embodiment illustrated, end caps 212, 213 are mounted on end walls 206, 207, respectively, such as by suitable fasteners (e.g., screws, rivets, etc.) or by a snap-fit engagement. An outlet port 214 is positioned on bottom 204*b* of body 203 near end wall 207. Toner is periodically delivered from reservoir 202 through outlet port 214 to inlet port 412 to refill reservoir 302, 302' of imaging unit 300, 300' as toner is consumed by the printing process.

Toner cartridge 200 includes one or more agitators (e.g., paddles, augers, etc.) to stir and move toner within reservoir 202 toward outlet port 214. In the example embodiment illustrated, a drive element 216, such as a gear or other form of drive coupler, is positioned on an outer surface of end wall 207. Drive element 216 is positioned to engage a corresponding drive element in image forming device 100, 100' when toner cartridge 200 is installed in tray 400 in order to receive rotational power to drive the agitator(s) in reservoir 202. The agitator(s) within reservoir 202 may be connected directly or by one or more intermediate gears to drive element 216. In one embodiment, body 203 includes a toner exit section 280 formed on bottom 204*b* of wall 204 near side 204*d* and end wall 207. Outlet port 214 is positioned on the bottom of toner exit section 280 near end wall 207. Toner exit section 280 includes a channel (not shown) that forms a path for toner to exit reservoir 202 through outlet port 214. In one embodiment, a rotatable auger (not shown) is positioned in the channel of toner exit section 280 to move toner to outlet port 214.

Toner cartridge 200 may include a positioning wing 228, 229 (FIGS. 8 and 9) on each side 204*c*, 204*d* of wall 204. Positioning wings 228, 229 extend along lengthwise dimension 205 between front end 208 and rear end 210. Positioning wings 228, 229 rest on loading rails 418, 420 allowing toner cartridge 200 to slide into and out of tray 400 from front end 408 along lengthwise dimensions 406, 205. Positioning wings 228, 229 are also restrained in the side-to-side direction by outer side restraints 423, 425 to limit the side-to-side movement of toner cartridge 200 in tray 400.

Figure 7:
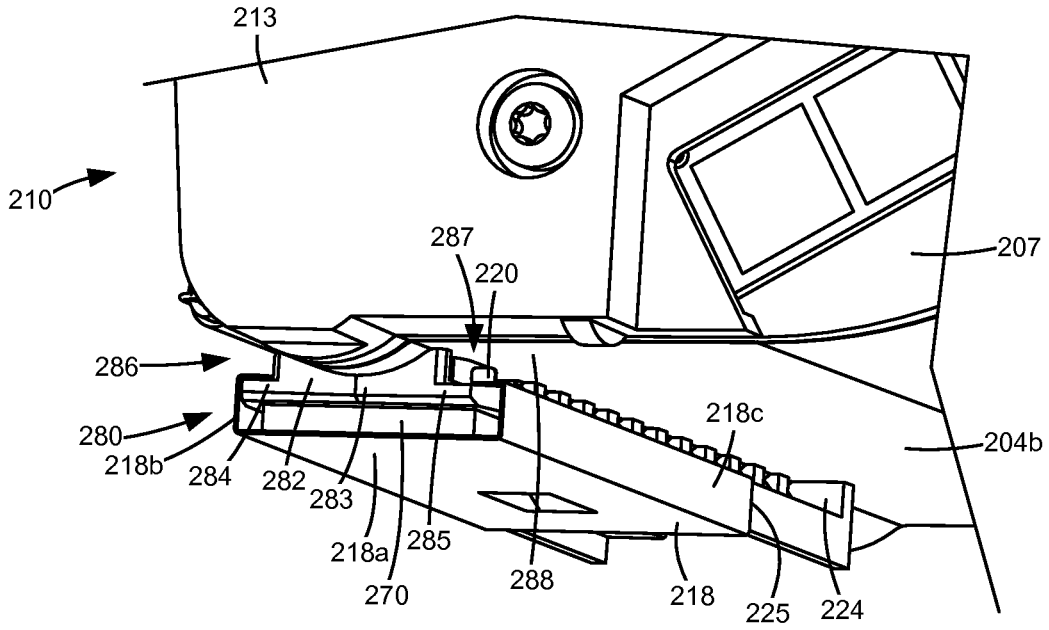
FIG. 7 is a rear perspective view of the toner cartridge shown in FIG. 6 showing a shutter in a closed position blocking an outlet port of the toner cartridge according to one example embodiment.

FIG. 7 shows the area of toner cartridge 200 near outlet port 214 in greater detail according to one example embodiment. In one embodiment, an inverted T-shaped extension 282 is formed at the bottom of a portion of toner exit section 280 near end wall 207. A chute 283 for toner to drop from the channel in toner exit section 280 to outlet port 214 extends downward from toner exit section 280 and forms the base of the inverted T-shaped extension 282. A pair of ledges 284, 285 extend away from each other toward opposite sides of body 203 and form the rest of the inverted T-shaped extension 282. Ledges 284, 285 run in lengthwise dimension 205 along the length of extension 282. A pocket 286, 287 is formed above each ledge 284, 285 below a bottom surface 288 of toner exit section 280. Each ledge 284, 285 may have a tapered lead-in surface at its rear end to facilitate entry of extension 282 into channel 414. Extension 282 is received by channel 414 when toner cartridge 200 is inserted into tray 400. Specifically, ledges 284, 285 of extension 282 pass below ledges 420*a*, 420*b*, above bottom surface 416 and between walls 418*a*. 418*b*. Chute 283 passes between ledges 420*a*, 420*b*. Ledges 420*a*, 420*b* enter pockets 286 and 287 below bottom surface 288 of toner exit section 280.

A shutter 218 is positioned on body 203 and is slidably movable between a closed position blocking outlet port 214 to prevent toner from escaping toner cartridge 200 and an open position unblocking outlet port 214 to permit toner to flow from outlet port 214 of toner cartridge 200. In the embodiment illustrated, shutter 218 is positioned on the bottom of extension 282. In this embodiment, shutter 218 includes a base 218*a* that forms the blocking portion of shutter 218 and flanges 218*b*, 218*c* that extend upward from base 218*a* on opposite sides of base 218*a*. Each flange 218*b*, 218*c* wraps over the top of a respective ledge 284, 285 to retain shutter 218 on extension 282. When shutter 218 slides between the open and closed positions, flanges 218*b*, 218*c* slide across top surfaces and outer side surfaces of ledges 284, 285. In this manner, ledges 284, 285 serve as rails that shutter 218 slides along. Shutter 218 may be biased toward the closed position blocking outlet port 214. For example, one or more extension springs 222 (FIG. 6) may bias shutter 218 toward the closed position as shown. In the example embodiment illustrated, shutter 218 slides toward front end 208 when shutter 218 moves from the closed position to the open position and toward rear end 210 when shutter 218 moves from the open position to the closed position.

Shutter 218 may include an engagement feature that engages a corresponding feature in image forming device 100, 100' to open shutter 218 when toner cartridge 200 is inserted into image forming device 100, 100' as outlet port 214 aligns with inlet port 412. For example, in the embodiment illustrated, shutter 218 includes an actuation tab 220 extending from shutter 218 in a direction generally orthogonal to lengthwise dimension 205. Actuation tab 220 is positioned to receive a force from a surface in image forming device 100, 100', such as one of the walls 418 or ledges 420 forming channel 414, during insertion of toner cartridge 200 into tray 400. In the example embodiment illustrated, tab 220 extends from flange 218*c* that is positioned proximate to an inner portion of body 203 in the side-to-side direction and away from side 204*d*. In this example, tab 220 extends upward from flange 218*c* into pocket 287. In this position, tab 220 is protected by ledge 285 and bottom surface 288 of toner exit section 280 from accidental actuation by a user when toner cartridge 200 is not installed in the image forming device. In another embodiment, tab 220 extends sideways from flange 218*c* away from side 204*d* and toward side 204*c*. In other embodiments, tab 220 extends upward or sideways from flange 218*b* or downward from base 218*a*. In other embodiments, shutter 218 does not include tab 220 and a portion of base 218*a*, flange 218*b* and/or flange 218*c* receives a force from one of the walls 418 or ledges 420 forming channel 414 during insertion of toner cartridge 200 into tray 400.

Shutter 218 may include a seal 270 sandwiched between shutter 218 and the bottom of extension 282 to blocks toner from leaking from outlet port 214. In one embodiment, seal 270 is fixed to shutter 218 and slides with shutter 218 against extension 282. In another embodiment, seal 270 is fixed on a bottom surface of extension 282 surrounding outlet port 214. In this embodiment, seal 270 includes an opening aligned with outlet port 214 to allow toner to exit outlet port 214. Seal 270 may be composed of a foam material such as PORON® from Rogers Corporation, Rogers, Conn., USA.

Shutter 218 includes forward and rearward stops that prevent shutter 218 from overtraveling toward front end 208 and rear end 210 of toner cartridge 200. In the example embodiment illustrated, a forward stop 224 is positioned at a front end of ledge 284 and/or ledge 285. When shutter 218 reaches the end of its travel toward front end 208 of toner cartridge 200, a front end 225 of shutter 218 contacts forward stop 224 thereby limiting the forward motion of shutter 218.

Figure 8:
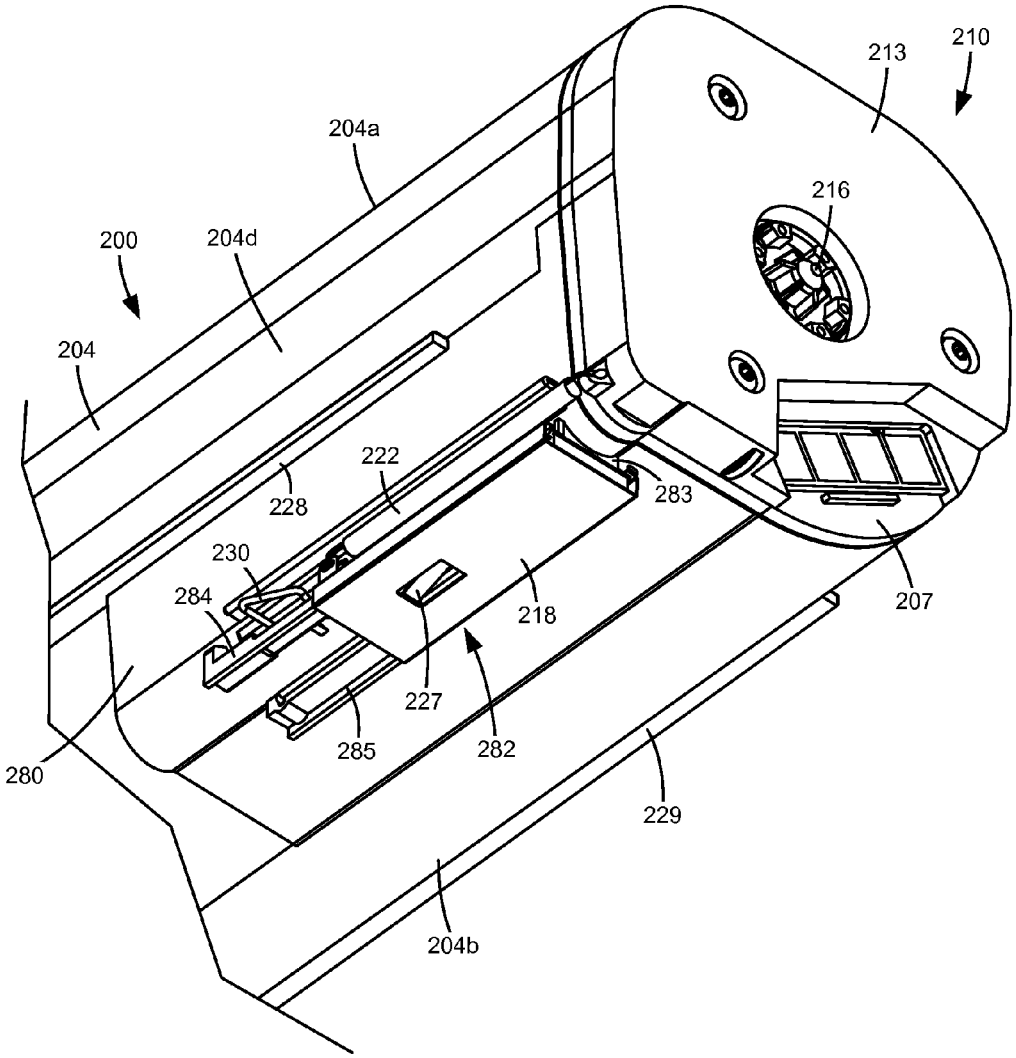
FIG. 8 is a bottom perspective view of the toner cartridge shown in FIGS. 6 and 7 showing the shutter in the closed position according to one example embodiment.
Figure 9:
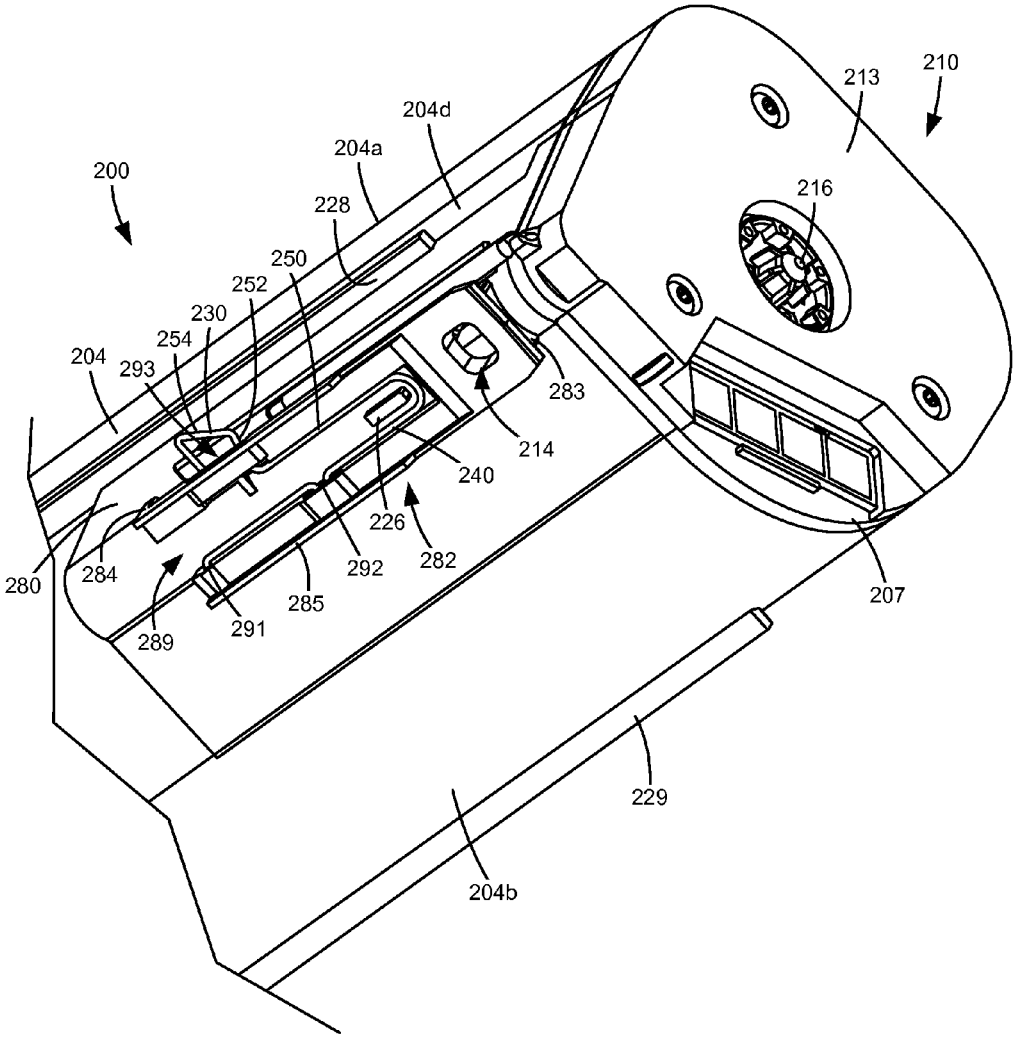
FIG. 9 is a bottom perspective view of the toner cartridge shown in FIGS. 6-8 with the shutter removed showing a shutter lock according to one example embodiment.

FIGS. 8 and 9 show a bottom perspective view of the area surrounding outlet port 214. Shutter 218 is removed in FIG. 9 to illustrate the components positioned between shutter 218 and the bottom of toner exit section 280. In the embodiment illustrated, ledges 284, 285 extend from outlet port 214 toward front end 208 of toner cartridge 200 along the bottom of toner exit section 280 with a channel 289 formed between the portions of ledge 284 and ledge 285 in front of chute 283. In this manner, each ledge 284, 285 forms an L-shaped extension from the bottom of toner exit section 280 that runs along lengthwise dimension 205 forward from chute 283. In this embodiment, a rearward stop 226 is positioned in channel 289 between ledge 284 and ledge 285 in front of outlet port 214. In the embodiment illustrated, shutter 218 includes a tab 227 that extends at an angle toward rear end 210 and toward the bottom of toner exit section 280 between ledges 284 and 285. When shutter 218 reaches the end of its travel toward rear end 210 of toner cartridge 200, tab 227 of shutter 218 contacts rearward stop 226 thereby limiting the rearward motion of shutter 218.

Toner cartridge 200 includes a shutter lock 230 that prevents shutter 218 from opening unless toner cartridge 200 is installed in image forming device 100, 100'. In the embodiment illustrated, lock 230 is sandwiched between a top portion of shutter 218 and the bottom of toner exit section 280 along which shutter 218 slides, such as in channel 289 between ledge 284 and ledge 285.

Figure 10:
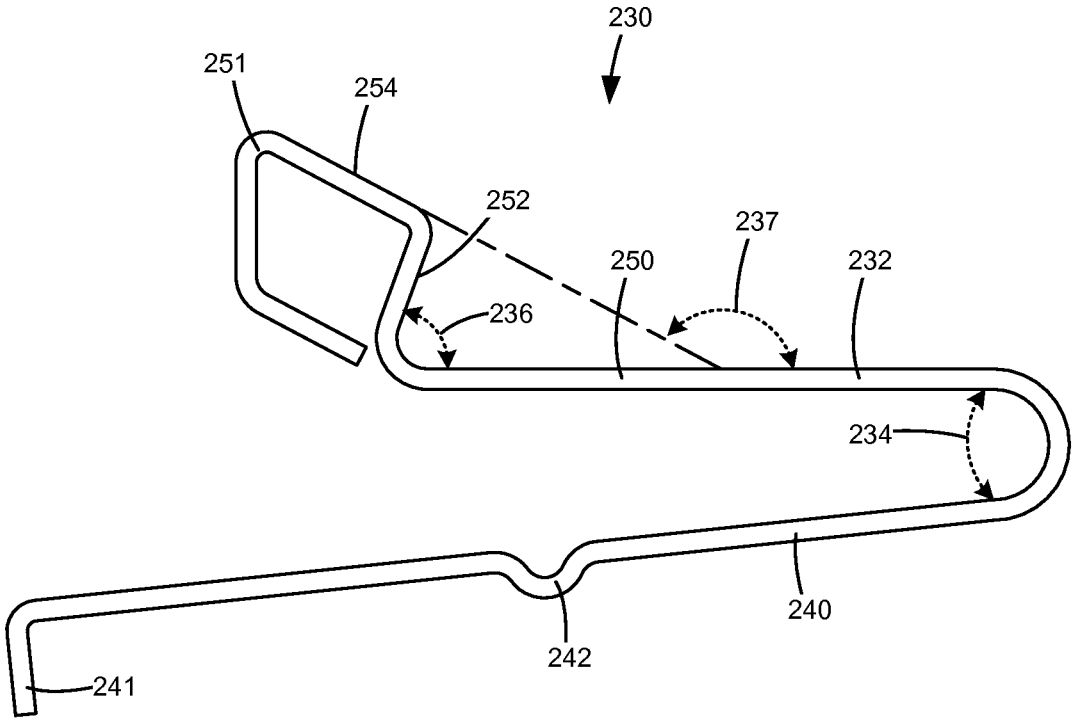
FIG. 10 is a bottom plan view of the shutter lock shown in FIGS. 8 and 9 according to one example embodiment.

With reference to FIGS. 9 and 10, lock 230 includes a resiliently deflectable member 232. In the embodiment illustrated, lock 230 includes a resilient metal wire. In another embodiment, lock 230 includes a resilient plastic member. Lock 230 includes a bias arm 240 and a locking arm 250. In the embodiment illustrated, the resilient wire has a bend formed therein such that a portion of the wire on one side of the bend forms bias arm 240 and a portion of the wire on the other side of the bend forms locking arm 250. As discussed in greater detail below, locking arm 250 is movable between a locked position preventing shutter 218 from opening and an unlocked position permitting shutter 218 to open. Locking arm 250 is biased by bias arm 240 toward the locked position.

Lock 230 is mounted to ledges 284, 285 in a manner that prevents undesired motion of lock 230 relative to body 203 while permitting locking arm 250 to move between the locked position and the unlocked position. In the embodiment illustrated, lock 230 includes a pair of alignment tabs 241, 242 positioned on bias arm 240 and an alignment tab 251 positioned on locking arm 250. In this embodiment, alignment tab 241 is in the shape of a pin positioned at a frontmost portion of bias arm 240 and is received in a corresponding slot 291 on an inner side surface of ledge 285. The engagement between alignment tab 241 and slot 291 prevents undesired front-to-rear motion of lock 230 relative to body 203. In the embodiment illustrated, alignment tab 242 is positioned on a portion of bias arm 240 spaced rearward from alignment tab 241 and is received in a corresponding slot 292 on the inner side surface of ledge 285. Alignment tab 251 is positioned near a frontmost portion of locking arm 250 and is received in a corresponding slot 293 on an inner side surface of ledge 284. The engagement between alignment tabs 241, 242, 251 and slots 291, 292, 293 prevents undesired vertical motion of lock 230 relative to body 203. It will be appreciated that the mounting configuration of lock 230 on body 203 illustrated is intended to serve as an example and that lock 230 may be mounted according to any suitable configuration that prevents unwanted motion of lock 230 while permitting locking arm 250 to move between the locked and unlocked positions. For example, the locations and shapes of alignment tabs 241, 242, 251 on bias arm 240 and/or locking arm 250 may vary as desired. Further, one or more of alignment tabs 241, 242, 251 may be replaced with an alignment slot that receives a corresponding projection from ledge 284 or 285.

FIG. 10 shows the resilient wire of lock 230 in its free state, prior to mounting on toner cartridge 200. In its free state, bias arm 240 and locking arm 250 form an open angle 234 between them. When lock 230 is mounted on body 203 of toner cartridge 200, angle 234 between bias arm 240 and locking arm 250 closes placing a load between bias arm 240 and locking arm 250. As shown in FIG. 9, the load between bias arm 240 and locking arm 250 biases both arms 240, 250 against the inner side surfaces of ledges 285, 284. This is the locked position of locking arm 250, biased against the inner side surface of ledge 284 by the engagement between bias arm 240 and the inner side surface of ledge 285.

With continued reference to FIGS. 9 and 10, locking arm 250 includes a blocking surface 252 that is in the path of shutter 218 when locking arm 250 is in the locked position to prevent shutter 218 from opening. In the embodiment illustrated, blocking surface 252 is positioned on a rear portion of alignment tab 251. When locking arm 250 is in the locked position, alignment tab 251 extends through slot 293 in ledge 284 such that blocking surface 252 is in the sliding path of shutter 218. In this manner, blocking surface 252 prevents shutter 218 from sliding toward front end 208 from the closed position to the open position when locking arm 250 is in the locked position. Locking arm 250 also includes a camming surface 254 positioned to contact an engagement feature of image forming device 100, 100' when toner cartridge 200 is inserted into tray 400 to cause locking arm 250 to move from the locked position to the unlocked position with blocking surface 252 clear of the sliding path of shutter 218 in order to permit shutter 218 to move from the closed position to the open position.

Figure 11:
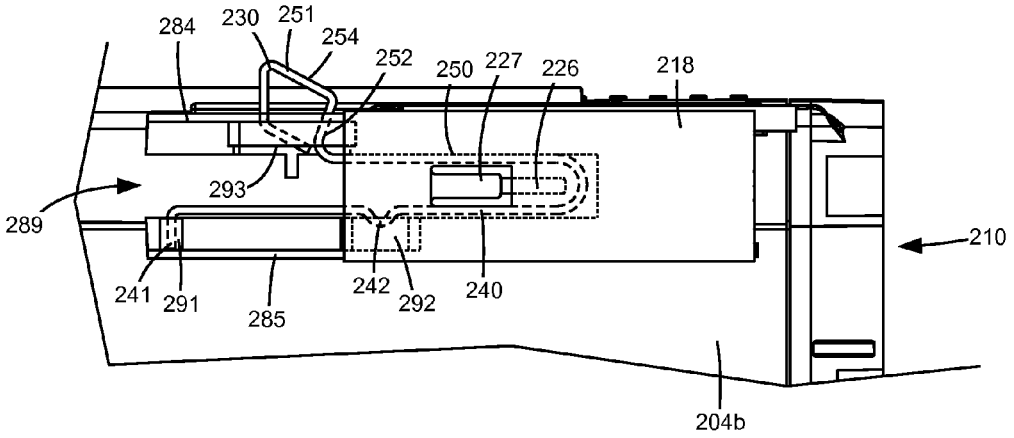
FIG. 11 is a bottom plan view of the shutter in the closed position and the shutter lock in a locked position according to one example embodiment.
Figure 12:
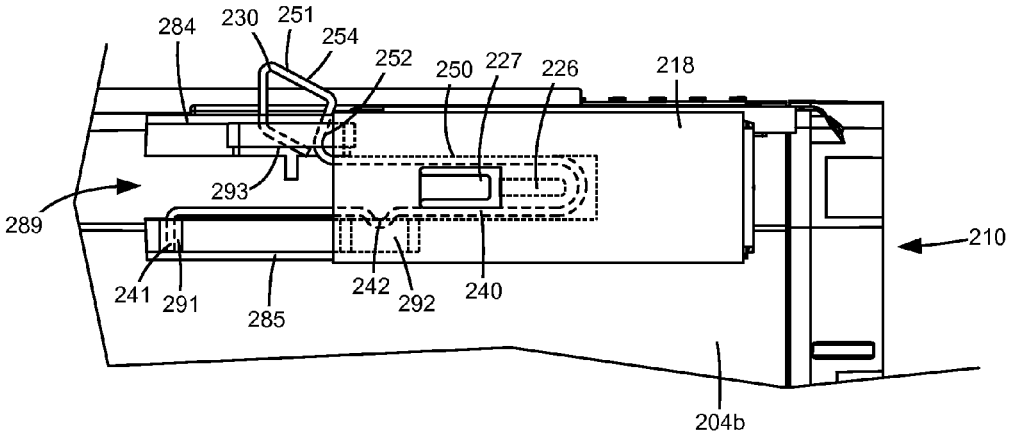
FIG. 12 is a bottom plan view of the shutter moving from the closed position toward an open position with the shutter lock in the locked position according to one example embodiment.

FIGS. 11-14 illustrate the operation of lock 230 according to one example embodiment in greater detail. The portions of lock 230, alignment slots 291, 292, 293 and ledges 284, 285 that are obscured by shutter 218 are shown in dashed lines. FIG. 11 shows lock 230 with locking arm 250 in the locked position and shutter 218 in the closed position. FIG. 12 shows shutter 218 advanced forward slightly from the closed position toward the open position with locking arm 250 in the locked position. As shutter 218 moves from the closed position toward the open position, shutter 218 contacts blocking surface 252 of lock 230, which prevents shutter 218 from advancing farther toward the open position. In the embodiment illustrated, blocking surface 252 forms an acute angle 236 (FIG. 10) with respect to the direction of travel of shutter 218, to ledge 284 and to the portion of locking arm 250 extending along ledge 284. The angle of blocking surface 252 helps prevent shutter 218 from displacing locking arm 250 from the locked position to the unlocked position so that shutter 218 does not move past blocking surface 252 to the open position. In another embodiment, blocking surface 252 is substantially perpendicular to the direction of travel of shutter 218, to ledge 284 and to the portion of locking arm 250 extending along ledge 284.

Figure 13:
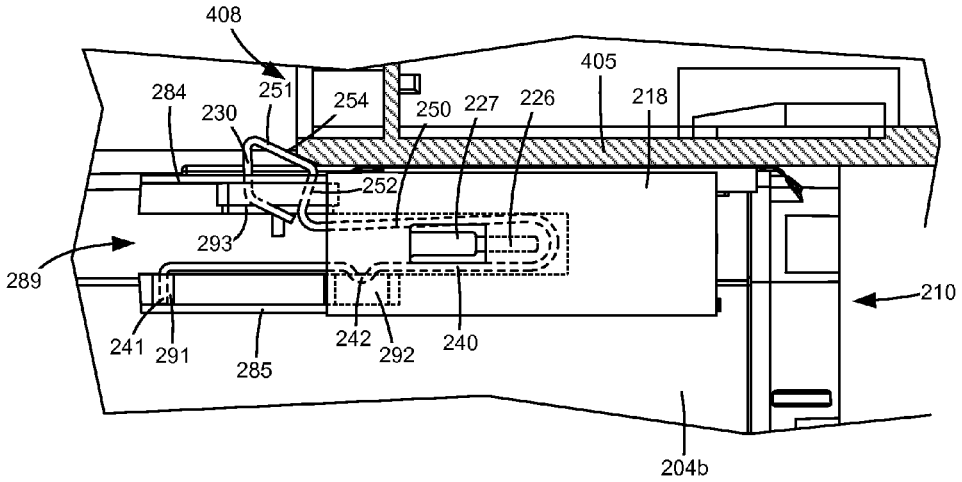
FIG. 13 is a bottom plan view of the shutter and the shutter lock as the toner cartridge is inserted into the tray showing the shutter lock contacting the tray and moving from the locked position to an unlocked position according to one example embodiment.

FIG. 13 shows shutter 218 and lock 230 as toner cartridge 200 is inserted into tray 400. As toner cartridge 200 enters tray 400, camming surface 254 of lock 230 contacts a surface of tray 400, such as a side wall 405 of tray 400 adjacent to side 204*d* of body at front end 408 of tray 400, causing locking arm 250 to move from the locked position to the unlocked position. Specifically, when camming surface 254 receives a force along the direction of insertion of toner cartridge 200 into image forming device 100, 100', the contact on camming surface 254 causes locking arm 250 to flex toward bias arm 240 until blocking surface 252 is no longer in the path of shutter 218. In the embodiment illustrated, camming surface 254 forms an obtuse angle 237 (FIG. 10) with respect to the direction of travel of shutter 218, to ledge 284 and to the portion of locking arm 250 extending along ledge 284. The angle of camming surface 254 causes locking arm 250 to flex toward bias arm 240 when camming surface 254 receives a force that is substantially parallel to the direction of motion of shutter 218 (e.g., when camming surface 254 contacts a front edge of surface 405 of tray 400). However, the angle of camming surface 254 may vary depending on the relative angle and position of the surface of tray 400 that camming surface 254 contacts. In the embodiment illustrated, camming surface 254 extends directly from blocking surface 252.

Figure 14:
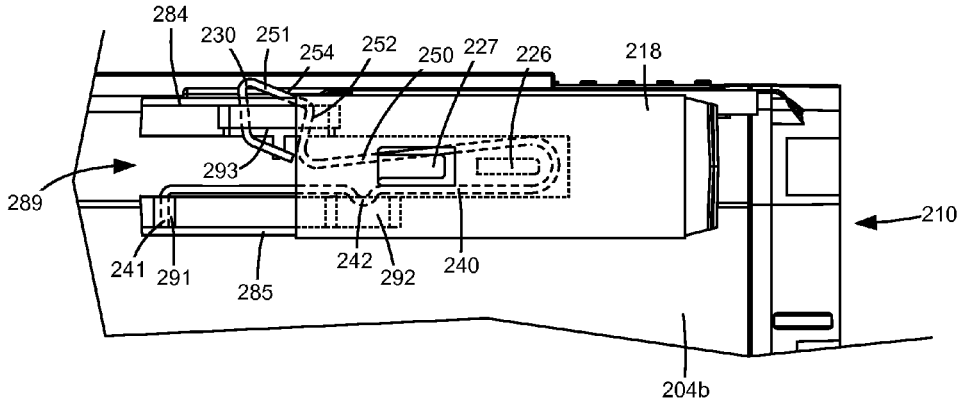
FIG. 14 is a bottom plan view of the shutter and the shutter lock as the shutter begins to open according to one example embodiment.

FIG. 14 shows lock 230 with locking arm 250 in the unlocked position as shutter 218 begins to move from the closed position to the open position as a result of contact between actuation tab 220 and the surfaces forming channel 414 as toner cartridge 200 nears its final position in tray 400 with outlet port 214 nearing inlet port 412. As shown in FIG. 14, in the embodiment illustrated, the contact between side wall 405 and camming surface 254 clears blocking surface 252 from the path of shutter 218 but leaves a portion of camming surface 254 in the path of shutter 218. As a result, as shutter 218 moves toward the open position, shutter 218 contacts camming surface 254 causing locking arm 250 to flex further toward bias arm 240 as shutter 218 advances along camming surface 254.

Figure 15:
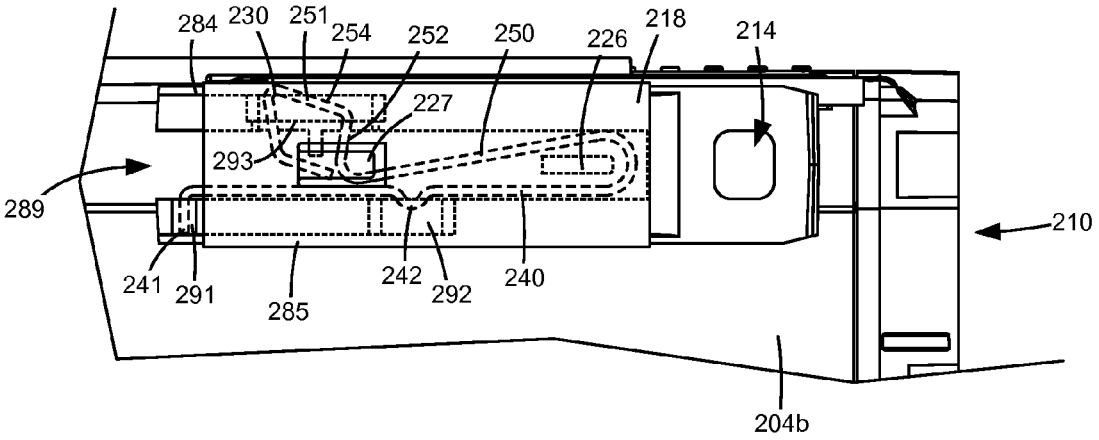
FIG. 15 is a bottom plan view of the shutter and the shutter lock with the shutter in the open position according to one example embodiment.

FIG. 15 shows shutter 218 in the open position with outlet port 214 unblocked to deliver toner to inlet port 412. As shutter 218 advances to the open position, contact between shutter 218 and camming surface 254 causes locking arm 250 to flex further toward bias arm 240 with alignment tab 251 retracted to a position between flanges 218*b*, 218*c* of shutter 218 and camming surface 254 in contact with an inner side surface of flange 218*b*. In one embodiment, when camming surface 254 is in contact with the inner side surface of flange 218*b* of shutter 218, the free end of locking arm 250 does not contact or cross bias arm 240 so that locking arm 250 does not catch on or tangle with bias arm 240.

When toner cartridge 200 is removed from tray 400, this sequence is reversed to close shutter 218 and move locking arm 250 of lock 230 back to the locked position. When toner cartridge 200 is removed from tray 400, extension 282 begins to reverse out of channel 414. As extension 282 moves away from channel 414, shutter 218 begins to move to the closed position from the open position as a result of the bias on shutter 218. As shutter 218 moves toward the closed position, locking arm 250 flexes away from bias arm 240 and toward ledge 284 as the front edge of shutter 218 passes along and clears camming surface 254. Locking arm 250 remains in the unlocked position until camming surface 254 clears the front edge of side wall 405 of tray 400 at which point locking arm 250 returns to the locked position with blocking surface 252 in the path of shutter 218 as a result of the bias on locking arm 250.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge, comprising:

a body having a reservoir for storing toner, the body having an outlet port in fluid communication with the reservoir for exiting toner from the reservoir;

a shutter positioned at the outlet port that is slidable between a closed position blocking the outlet port and an open position unblocking the outlet port; and a lock sandwiched between a portion of the shutter that faces the outlet port and a portion of the body that the shutter slides along, the lock is movable between a locked position blocking the shutter from moving from the closed position to the open position and an unlocked position permitting the shutter to move from the closed position to the open position.

2. The toner cartridge of claim 1, wherein the lock includes a locking arm and a bias arm, the locking arm includes a blocking surface and is movable between the locked position where the blocking surface blocks the shutter from moving from the closed position to the open position and the unlocked position where the blocking surface is clear from a sliding path of the shutter permitting the shutter to move from the closed position to the open position, and the locking arm is biased by the bias arm toward the locked position.

3. The toner cartridge of claim 2, wherein the lock includes a resiliently deflectable wire having a bend formed therein, a portion of the wire on one side of the bend forms the locking arm and a portion of the wire on the other side of the bend forms the bias arm.

4. The toner cartridge of claim 2, wherein the locking arm includes a camming surface positioned, when the locking arm is in the locked position, to receive a force along a direction of sliding movement of the shutter and the received force causes the locking arm to move from the locked position to the unlocked position.

5. The toner cartridge of claim 4, wherein, in the locked position, the blocking surface forms an acute angle relative to the sliding path of the shutter and the camming surface forms an obtuse angle relative to the sliding path of the shutter.

6. The toner cartridge of claim 1, wherein the lock includes a camming surface positioned, when the lock is in the locked position, to receive a force along a direction of sliding movement of the shutter and the received force causes the lock to move from the locked position to the unlocked position.

7. The toner cartridge of claim 1, further comprising a pair of opposed rails extending along a sliding path of the shutter, wherein the shutter slides along the rails when the shutter slides between the open position and the closed position, wherein the lock is mounted on the rails independent of the shutter.

8. A toner cartridge, comprising:

a body having a reservoir for storing toner, the body having an outlet port in fluid communication with the reservoir for exiting toner from the reservoir;

a shutter positioned at the outlet port that is slidable between a closed position blocking the outlet port and an open position unblocking the outlet port; and a resiliently deflectable wire having a bend formed therein, a portion of the wire on one side of the bend forms a locking arm and a portion of the wire on the other side of the bend forms a bias arm, the locking arm includes a blocking surface and is movable between a locked position where the blocking surface blocks the shutter from moving from the closed position to the open position and an unlocked position where the blocking surface is clear from a sliding path of the shutter permitting the shutter to move from the closed position to the open position, the locking arm is biased by the bias arm toward the locked position.

9. The toner cartridge of claim 8, wherein the locking arm includes a camming surface positioned, when the locking arm is in the locked position, to receive a force along a direction of sliding movement of the shutter and the received force causes the locking arm to move from the locked position to the unlocked position.

10. The toner cartridge of claim 9, wherein, in the locked position, the blocking surface forms an acute angle relative to the sliding path of the shutter and the camming surface forms an obtuse angle relative to the sliding path of the shutter.

11. The toner cartridge of claim 8, wherein the wire is sandwiched between a portion of the shutter that faces the outlet port and a portion of the body that the shutter slides along.

12. The toner cartridge of claim 8, further comprising a pair of opposed rails extending along the sliding path of the shutter, wherein the shutter slides along the rails when the shutter slides between the open position and the closed position, wherein the wire is mounted on the rails independent of the shutter.

13. The toner cartridge of claim 12, wherein the blocking surface is formed on a first alignment tab on the locking arm and the first alignment tab is positioned in a corresponding first alignment slot in a first of the pair of rails, wherein the bias arm includes a second alignment tab and a third alignment tab and the second and third alignment tabs are received in corresponding second and third alignment slots in a second of the pair of rails, wherein the engagement between the first, second and third alignment tabs with the first, second and third alignment slots restricts motion of the wire orthogonal to movement of the locking arm between the locked position and the unlocked position.

14. The toner cartridge of claim 8, wherein the bias arm and the locking arm extend from the bend in a common direction along the sliding path of the shutter on opposite sides of the bend.

15. A toner cartridge, comprising:

a body having a reservoir for storing toner, the body having an outlet port in fluid communication with the reservoir for exiting toner from the reservoir;

a shutter positioned at the outlet port that is slidable between a closed position blocking the outlet port and an open position unblocking the outlet port;

a pair of opposed rails extending along a sliding path of the shutter, the shutter slides along the rails when the shutter slides between the open position and the closed position; and a lock mounted on the rails independent of the shutter, the lock is resiliently deflectable between a locked position blocking the shutter from moving from the closed position to the open position and an unlocked position permitting the shutter to move from the closed position to the open position.

16. The toner cartridge of claim 15, wherein the lock includes a locking arm and a bias arm, the locking arm includes a blocking surface and is movable between the locked position where the blocking surface blocks the shutter from moving from the closed position to the open position and the unlocked position where the blocking surface is clear from the sliding path of the shutter permitting the shutter to move from the closed position to the open position, and the locking arm is biased by the bias arm toward the locked position.

17. The toner cartridge of claim 16, wherein the lock includes a resiliently deflectable wire having a bend formed therein, a portion of the wire on one side of the bend forms the locking arm and a portion of the wire on the other side of the bend forms the bias arm.

18. The toner cartridge of claim 16, wherein the locking arm includes a camming surface positioned, when the locking arm is in the locked position, to receive a force along a direction of sliding movement of the shutter and the received force causes the locking arm to move from the locked position to the unlocked position.

19. The toner cartridge of claim 18, wherein, in the locked position, the blocking surface forms an acute angle relative to the sliding path of the shutter and the camming surface forms an obtuse angle relative to the sliding path of the shutter.

20. The toner cartridge of claim 15, wherein the lock includes a camming surface positioned, when the lock is in the locked position, to receive a force along a direction of sliding movement of the shutter and the received force causes the lock to move from the locked position to the unlocked position.

* * * * *